US009111666B2

(12) United States Patent
Furukawa et al.

(10) Patent No.: US 9,111,666 B2
(45) Date of Patent: Aug. 18, 2015

(54) AUTOMOTIVE INSULATED WIRE, AND AUTOMOTIVE WIRING HARNESS

(75) Inventors: Toyoki Furukawa, Yokkaichi (JP); Masashi Sato, Yokkaichi (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 132 days.

(21) Appl. No.: 13/885,542

(22) PCT Filed: Dec. 26, 2011

(86) PCT No.: PCT/JP2011/080037

§ 371 (c)(1), (2), (4) Date: May 15, 2013

(87) PCT Pub. No.: WO2012/090921

PCT Pub. Date: Jul. 5, 2012

(65) Prior Publication Data

US 2013/0233588 A1 Sep. 12, 2013

(30) Foreign Application Priority Data

Dec. 27, 2010 (JP) ..... 2010-290702

(51) Int. Cl.
*H01B 7/00* (2006.01)
*H01B 3/30* (2006.01)
(Continued)

(52) U.S. Cl.
CPC ..... *H01B 7/17* (2013.01); *H01B 3/301* (2013.01); *H01B 3/423* (2013.01); *H01B 7/282* (2013.01); *H01B 7/2806* (2013.01)

(58) Field of Classification Search
CPC ..... H01B 7/17; H01B 7/00; H01B 3/00; H01B 7/0275; H01B 7/04; H01B 7/26; H01B 3/30; H01B 3/301; H01B 3/305; H01B 3/423; H01B 3/42; C08L 67/00; C08L 31/00; C08L 81/06; C08F 20/00; F23J 15/00; B01D 39/16
USPC ..... 174/72 A, 110 R, 36, 120 R, 121; 523/218; 525/148, 418, 437; 110/203; 95/285; 55/528
See application file for complete search history.

(56) References Cited

U.S. PATENT DOCUMENTS 4,460,736 A * 7/1984 Froix et al. ..... 524/539
6,329,055 B1 12/2001 Higashiura et al.
(Continued)

FOREIGN PATENT DOCUMENTS

CN 101321832 A 12/2008
CN 101911216 A 12/2010
(Continued)

OTHER PUBLICATIONS

Udel P3703nt Datasheet 2001.*
(Continued)

*Primary Examiner* — Timothy Thompson
*Assistant Examiner* — Guillermo Egoavil
(74) *Attorney, Agent, or Firm* — Oliff PLC

(57) ABSTRACT

There are provided an automotive insulated wire, and automotive wiring harness that have an excellent resistance to a liquid, and an excellent resistance to an electrolyte, and that can be provided at low cost without causing an increase in cost. An automotive insulated wire (1) includes a metallic conductor (2) and an insulation covering layer (3) that covers the outer periphery of the metallic conductor, wherein the insulation covering layer is made from a mixed resin composition that contains resin ingredients that contain an ingredient A: a polysulfone resin, and an ingredient B: an aromatic polyester resin, and wherein a total of 100 parts by mass of the ingredients A and B contained in the mixed resin composition consists of 95 to 60 parts by mass of the ingredient A, and 5 to 40 parts by mass of the ingredient B.

16 Claims, 1 Drawing Sheet

(51) Int. Cl.

| | |
|---|---|
| ***H01B 3/42*** | (2006.01) |
| ***H01B 7/17*** | (2006.01) |
| ***H01B 7/282*** | (2006.01) |
| ***H01B 7/28*** | (2006.01) |

(56) References Cited

U.S. PATENT DOCUMENTS

| | | | | |
|---|---|---|---|---|
| 8,946,557 | B2 * | 2/2015 | Fukuda et al. | 174/110 R |
| 2005/0252679 | A1 * | 11/2005 | Chang et al. | 174/120 R |
| 2007/0197739 | A1 * | 8/2007 | Aneja et al. | 525/437 |
| 2008/0234440 | A1 * | 9/2008 | Brademeyer et al. | 525/418 |
| 2008/0255309 | A1 * | 10/2008 | Weinberg et al. | 525/148 |
| 2010/0095876 | A1 * | 4/2010 | Looney et al. | 110/203 |
| 2010/0101824 | A1 * | 4/2010 | Fujimoto et al. | 174/110 SR |
| 2010/0252322 | A1 * | 10/2010 | Sato et al. | 174/72 A |
| 2012/0279753 | A1 | 11/2012 | Kambe et al. | |

FOREIGN PATENT DOCUMENTS

| | | |
|---|---|---|
| JP | A-02-273411 | 11/1990 |
| JP | A-04-004512 | 1/1992 |
| JP | A-05-225832 | 9/1993 |
| JP | A-11-066958 | 3/1999 |
| JP | A-2010-198898 | 9/2010 |
| WO | WO 99/19885 | 4/1999 |
| WO | WO 2011/108590 A1 | 9/2011 |

OTHER PUBLICATIONS www_COMFIL_biz polymer type melting pt.*
Design Guide_Salvoy Advanced Polymers 2004.*
Mar. 27, 2012 International Search Report issued in International Application No. PCT/JP2011/080037.
Jan. 21, 2015 Office Action issued in Chinese Application No. CN201180062894.1.

* cited by examiner

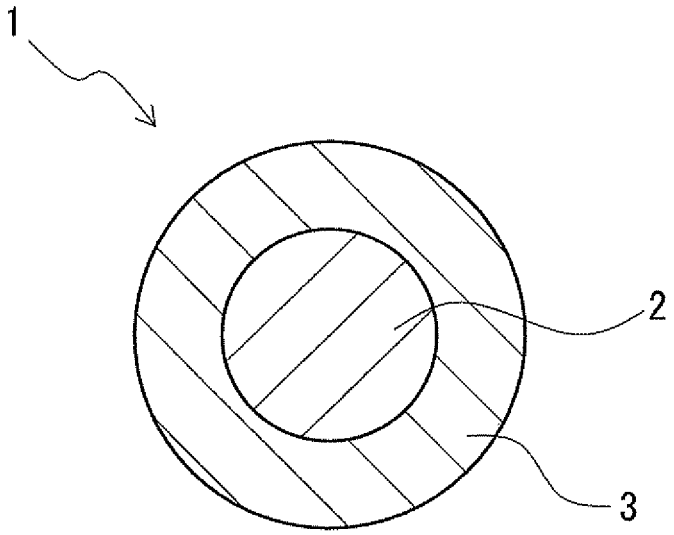
1
2
3

AUTOMOTIVE INSULATED WIRE, AND AUTOMOTIVE WIRING HARNESS

TECHNICAL FIELD

The present invention relates to an automotive insulated wire, and automotive wiring harness.

BACKGROUND ART

Generally, a polyvinyl chloride resin composition is used for an insulator of a conventional automotive low-voltage wire because the polyvinyl chloride resin composition is excellent in flame retardancy and chemical resistance.

It is known that in recent years, so-called super engineering plastics that have great mechanical strength such as polyether imide, polysulfone, polyethersulfone, polyphenylsulfone and polyether ether ketone are used for a material of an insulator of a generally-used insulated wire (see PTL 1 and PTL 2, for example). Attempts to use these super engineering plastics for insulators in automotive insulated wires have been made.

CITATION LIST

Patent Literature

PTL 1: Japanese Unexamined Patent Application Publication No. 04-4512

PTL 2: Japanese Unexamined Patent Application Publication No. 05-225832

DISCLOSURE OF THE INVENTION

Problems to be Solved by the Invention

Automotive insulated wires could be sometimes in contact with gasoline or an electrolyte when used. For this reason, the automotive insulated wires are required of having as the properties of the automotive insulated wires a resistance to a liquid such as gasoline, and a resistance to an electrolyte. However, there arises a problem that because the super engineering plastics such as polyether imide, polysulfone, polyethersulfone and polyphenylsulfone that are used for the insulators of the insulated wires define amorphous materials, the super engineering plastics cannot satisfy the properties such as a resistance to a liquid including a resistance to gasoline.

Meanwhile, aromatic polyester resins define crystalline resins, and it is known that the aromatic polyester resins have an excellent resistance to a liquid as the materials of the insulators. However, there is a problem that the aromatic polyester resins have a poor resistance to an electrolyte.

While adding polyether ether ketone to polyethersulfone can improve the resistance to a liquid and the resistance to an electrolyte, the use of the expensive polyether ether ketone in the resin ingredients causes a problem of a remarkable increase in cost for the insulated wires, which is not a realistic solution to the problem.

The present invention is made in view of the problems described above, and an object of the present invention is to provide an automotive insulated wire, and automotive wiring harness that have an excellent resistance to a liquid such as a resistance to gasoline, and an excellent resistance to an electrolyte, and that can be provided at low cost without causing an increase in cost.

Means of Solving the Problems

To achieve the objects and in accordance with the purpose of the present invention, an automotive insulated wire according to the present invention includes a metallic conductor and an insulation covering layer that covers the outer periphery of the metallic conductor. In the automotive insulated wire, the insulation covering layer is made from a mixed resin composition that contains resin ingredients that contain an ingredient A: a polysulfone resin, and an ingredient B: an aromatic polyester resin. In the automotive insulated wire, a total of 100 parts by mass of the ingredients A and B contained in the mixed resin composition consists of 95 to 60 parts by mass of the ingredient A, and 5 to 40 parts by mass of the ingredient B.

It is preferable that the ingredient A: the polysulfone resin, should have a flexural modulus of 2400 MPa or more, and should be one or more resins selected from the group consisting of polysulfone, polyethersulfone, and polyphenylsulfone.

It is preferable that the ingredient B: the aromatic polyester resin, should have a melting point of 240 degrees C. or higher, and should be one or more resins selected from the group consisting of polyethylene terephthalate, polybutylene naphthalate, and polyethylene naphthalate.

In another aspect of the present invention, an automotive wiring harness according to the present invention includes the automotive insulated wire described above.

Effects of the Invention

Including the insulation covering layer made from the mixed resin composition that contains the resin ingredients that contain the ingredient A: the polysulfone resin, and the ingredient B: the aromatic polyester resin, the total of 100 parts by mass of the ingredients A and B of the resin ingredients consisting of 95 to 60 parts by mass of the ingredient A, and 5 to 40 parts by mass of the ingredient B, the automotive insulated wire according to the present invention and the automotive wiring harness according to the present invention has a resistance to a liquid such as resistance to gasoline, and a resistance to an electrolyte more excellent than an automotive insulated wire and an automotive wiring harness that have an insulation covering layer made from only either one of a polysulfone resin and an aromatic polyester resin. Further, expensive polyether ether ketone is not used as the resin ingredient in the present invention, which does not cause an increase in cost of materials. Thus, the automotive insulated wire according to the present invention and the automotive wiring harness according to the present invention can be provided at low prices.

BRIEF DESCRIPTION OF DRAWINGS

FIG. 1 is a cross-sectional view showing one example of an automotive insulated wire according to the present invention.

MODE FOR CARRYING OUT THE INVENTION

Hereinafter, a detailed description according to preferred embodiments of the present invention will be provided. FIG. 1 is a cross-sectional view showing one example of an automotive insulated wire according to the present invention. An automotive insulated wire 1 shown in FIG. 1 includes a metallic conductor 2, and an insulation covering layer 3 that covers the outer periphery of the metallic conductor 2 and is made from a mixed resin composition that contains an ingredient A: a polysulfone resin, and an ingredient B: an aromatic polyester resin.

The metallic conductor 2 is generally made from copper, but may be made from aluminum or magnesium instead of copper. In addition, the metallic conductor 2 may be made from copper containing other metals. Examples of the other metals include iron, nickel, magnesium, and silicon. In addition to the metals described above, metals that are in widespread use as conductors in general may be used by being added to the copper in the metallic conductor 2, or may be used alone in the metallic conductor 2.

The cross-section area of the metallic conductor 2 is not limited specifically. A single wire or a stranded wire consisting of a plurality of wires may be used for the metallic conductor 2. When the stranded wire is used, the metallic conductor 2 can be reduced in diameter by stranding to compress the stranded wire.

The thickness of the insulation covering layer 3 is not limited specifically as long as the insulation covering layer 3 can deliver insulation performance. The insulation covering layer 3 can be formed to have an appropriate thickness depending on the intended use of the insulated wire. When the insulation covering layer 3 has a thickness equal to or more than 0.025 mm, the coat of the insulation covering layer 3 can be formed uniformly, so that the insulation covering layer 3 can have a resistance to a liquid, and a resistance to an electrolyte in a convincing way.

It is to be noted that the automotive insulated wire is sometimes required of having the insulation covering layer that is small in thickness, and having the wire that is small in diameter from the viewpoint of weight saving and space saving. In such a case, if the insulated wire 1 includes the insulation covering layer 3 having a thickness of 0.3 mm or less, preferably 0.1 mm or less, for example, the insulated wire 1 has large effects of saving weight and space.

In the insulation covering layer 3, a total of 100 parts by mass of the ingredient A: the polysulfone resin, and the ingredient B: the aromatic polyester resin consists of 95 to 60 parts by mass of the ingredient A, and 5 to 40 parts by mass of the ingredient B.

A thermoplastic polysulfone resin having a sulphonyl group in the main chain thereof is used for the above-described polysulfone resin. Examples of the thermoplastic polysulfone resin include polysulfone, polyethersulfone, and polyphenylsulfone.

It is preferable to use a polysulfone resin that has a flexural modulus of 2400 MPa or more, and is one or more resins selected from the group consisting of polysulfone, polyethersulfone and polyphenylsulfone for the above-described polysulfone resin from the viewpoint of improving wear resistance of the insulated wire. The flexural modulus defines a value that is measured according to "PLASTICS—DETERMINATION OF FLEXURAL PROPERTIES" of ISO 178 (ASTM-D790) under an absolute dry condition at 23 degrees C. It is preferable that the flexural modulus of the polysulfone resin should be 2800 MPa or more.

A thermoplastic aromatic polyester resin having an aromatic ring and an ester bonding in the main chain thereof is used for the above-described ingredient B: the aromatic polyester resin. Examples of the preferably used thermoplastic aromatic polyester resin include polyethylene terephthalate, polybutylene naphthalate, and polyethylene naphthalate.

It is preferable that one or more kinds of the aromatic polyester resins having a melting point of 240 degrees C. or higher are used among the above-described aromatic polyester resins from the viewpoint of mixing performance and compatibility with the polysulfone resin. It is preferable that the melting point of the aromatic polyester resin should be 260 degrees C. or higher.

The reason why the content of the ingredient B: the aromatic polyester resin, is 5 to 40 parts by mass in the total of 100 parts by mass of the ingredients A and B is described below. If the ingredient B is less than 5 parts by mass, the insulation covering layer 3 has an unimproved resistance to a liquid. On the other hand, if the ingredient B is more than 40 parts by mass, the insulation covering layer 3 has an unsatisfactory resistance to an electrolyte.

It is preferable that the mixed resin composition for the insulation covering layer 3 should contain additives of various kinds such as a filler, a coloring agent, an antioxidant and an antiaging agent, which are generally used for an insulation covering layer of an insulated wire, in addition to the ingredients A and B within a range of not impairing the effects of the present invention.

The insulation covering layer 3 may be a single layer as shown in FIG. 1, or a multilayer consisting of two or more layers (not illustrated). When the insulation covering layer 3 is a multilayer consisting of two or more layers, the layers may be made from a same material or different materials as long as the layers are made from the above-described specific mixed resin composition.

The automotive insulated wire according to the present invention is produced by the following method. For example, the ingredients of the mixed resin composition from which the insulation covering layer 3 is made are kneaded with the use of a regular kneader such as an extruder (a single-screw extruder, a twin-screw extruder), a Banbury mixer, a pressure kneader, and a roll, and then the metallic conductor 2 is extrusion-covered with the insulation covering layer 3 with the use of a regular extrusion molding machine. In this manner, the automotive insulated wire 1 can be produced.

An automotive wiring harness according to the present invention is made of the automotive insulated wire 1 including the insulation covering layer 2 that is made from the specific mixed resin composition. The wiring harness is subjected to processing for connecting the end of the automotive insulated wire 1 with a connecting terminal or a connector, processing for bunching a plurality of the automotive insulated wires 1, or processing for connecting a plurality of the automotive insulated wires 1 with each other.

Each of the automotive insulated wire according to the present invent ion and the automotive wiring harness according to the present invention has an excellent resistance to a liquid such as gasoline, and an excellent resistance to an electrolyte, and can be favorably used as an automotive low-voltage wire that is used at a site in contact with gasoline or an electrolyte of an automobile.

It is to be noted that the resistance to a liquid defines a resistance to a liquid such as a fluid including fuel like gasoline, an engine oil, and a brake oil. In addition, the resistance to an electrolyte defines a resistance to a diluted sulfuric acid.

EXAMPLE

A description of the present invention will now be specifically provided with reference to Examples and Comparative Examples.

Examples 1 to 32, Comparative Examples 1 to 32

[Production of the Insulated Wires]

Mixed resin compositions from which insulation covering layers were made were prepared based on the ingredient compositions of the ingredients A and the ingredients B shown in Tables 1 to 8, and each of the prepared mixed resin compositions was kneaded with the use of a twin-screw extruder at 300 to 350 degrees C. Conductors having the diameters shown in Tables 1 to 8 were each extrusion-covered with the kneaded compositions, and insulation covering layers having the insulation thicknesses shown in Tables 1 to 8 were formed on the outer peripheries of the conductors. Thus, insulated wires according to Examples 1 to 32 and Comparative Examples 1 to 32 were produced. The temperature for the extrusion molding was set to be 300 to 350 degrees C. at a die, and 300 to 350 degrees C. at a cylinder. In addition, the linear velocity for the extrusion molding was set to be 50 m/min. Tests to evaluate a resistance to a liquid and a resistance to an electrolyte were performed on the produced insulated wires. Results of the tests are also shown in Tables 1 to 8. The specific use materials of the ingredients and the test methods will be described below.

[Use Materials]

Polysulfone: UdelP-1700NT (flexural modulus: 2700 MPa, manufactured by SOLVAY ADVANCED POLYMERS K.K.).

Polyethersulfone: RadelA-300A (flexural modulus: 2900 MPa, manufactured by SOLVAY ADVANCED POLYMERS K.K.)

Polyphenylsulfone: RadelR-5800 (flexural modulus: 2400 MPa, manufactured by SOLVAY ADVANCED POLYMERS K.K.)

Polyethylene terephthalate: NOVAPEX GS400 (melting point: 256 degrees C., manufactured by MITSUBISHI CHEMICAL CORPORATION)

Polybutylene naphthalate: TQB-OT (melting point: 243 degrees C., manufactured by TEIJIN CHEMICALS LTD.)

polyethylene naphthalate: TEONEX TN-8065S (melting point: 265 degrees C., manufactured by TEIJIN CHEMICALS LTD.)

[Evaluation on a Resistance to a Liquid]

The insulated wires were each immersed in the specified seven kinds of liquids at specified temperatures for 20 hours in accordance with the ISO 6722. The change rates of the external diameters of the insulated wires were measured before and after the immersion in each liquid. The insulated wires, whose change rates of the external diameters were equal to or smaller than the specified values, and which had no electrical continuity caused by an insulation breakdown after performing winding tests on the insulated wires with the use of a mandrel that was five times as large in diameter as the insulated wires, and then performing withstand voltage tests of 1 kv for 1 minute on the insulated wires, were regarded as passed as to the resistance to each liquid. The other insulated wires were regarded as failed. The evaluations on the resistance to a liquid were made as follows. In the pass-fail test results of the seven liquids, the insulated wires that were regarded as passed as having the resistances to zero to three kinds of liquids were evaluated as poor. The insulated wires that were regarded as passed as having the resistances to four to six kinds of liquids were evaluated as average. The insulated wires that were regarded as passed as having the resistances to all of the seven kinds of liquids were evaluated as good. The evaluation temperatures, and the specified change rates of the external diameters as to the seven liquids (1) to (7) are shown below.

(1) Gasoline (evaluation temperature: 23 degrees C., specified change rate of external diameter: 15%)

(2) Diesel fuel (evaluation temperature: 23 degrees C., specified change rate of external diameter: 15%)

(3) Engine oil (evaluation temperature: 50 degrees C., specified change rate of external diameter: 15%)

(4) Ethanol (evaluation temperature: 23 degrees C., specified change rate of external diameter: 15%)

(5) Power steering fluid (evaluation temperature: 50 degrees C., specified change rate of external diameter: 30%)

(6) Automatic transmission fluid (evaluation temperature: 50 degrees C., specified change rate of external diameter: 25%)

(7) Engine coolant (evaluation temperature: 50 degrees C., specified change rate of external diameter: 15%)

[Evaluation on a Resistance to an Electrolyte]

The insulated wires were each left under the condition of 90 degrees C. after dropping a diluted sulfuric acid of 35% (mass %) on the insulated wires in accordance with the ISO 6722. A process to drop the diluted sulfuric acid on the same site of each insulated wire after 8 hours and after 16 hours was decided as one cycle. After repeating two cycles of dropping the diluted sulfuric acid, the insulated wires were placed at room temperature. The insulated wires that had no electrical continuity caused by an insulation breakdown after performing winding tests on the insulated wires with the use of a mandrel that was five times as large in diameter as the insulated wires, and then performing withstand voltage tests of 1 kv for 1 minute on the insulated wires were regarded as passed. The other insulated wires were regarded as failed.

TABLE 1

| | | Example | | | | | | | |
|---|---|---|---|---|---|---|---|---|---|
| | | 1 | 2 | 3 | 4 | 5 | 6 | 7 | 8 |
| Ingredient A | Polysulfone | 95 | | | 80 | | | 60 | |
| | Polyethersulfone | | 95 | | | 80 | | | 60 |
| | Polyphenylsulfone | | | 95 | | | 80 | | |
| Ingredient B | Polyethylene terephthalate | 5 | | | | | 20 | | 40 |
| | Polybutylene naphthalate | | 5 | | 20 | | | | |
| | Polyethylene naphthalate | | | 5 | | 20 | | 40 | |
| Insuration thickness (mm) | | 0.1 | 0.1 | 0.1 | 0.1 | 0.1 | 0.1 | 0.1 | 0.1 |
| Conductor cross-section area ($mm^2$) | | 0.35 | 0.35 | 0.35 | 0.35 | 0.35 | 0.35 | 0.35 | 0.35 |
| External diameter(mm) | | 0.90 | 0.90 | 0.90 | 0.90 | 0.90 | 0.90 | 0.90 | 0.90 |
| Wire evaluation | Resistance to liquid | Good | Good | Good | Good | Good | Good | Good | Good |
| | Resistance to electrolyte | Passed | Passed | Passed | Passed | Passed | Passed | Passed | Passed |

TABLE 2

| | | Example | | | | | | | |
|---|---|---|---|---|---|---|---|---|---|
| | | 9 | 10 | 11 | 12 | 13 | 14 | 15 | 16 |
| Ingredient A | Polysulfone | | 50 | | 40 | | | | 40 |
| | Polyethersulfone | | 30 | 60 | 10 | 50 | | 60 | |
| | Polyphenylsulfone | 60 | | 10 | 10 | 45 | 70 | 15 | 20 |
| Ingredient B | Polyethylene terephthalate | | 10 | | 20 | | 10 | | |
| | Polybutylene naphthalate | 40 | 10 | | 10 | | 10 | 15 | 20 |
| | Polyethylene naphthalate | | | 30 | 10 | 5 | 10 | 10 | 20 |
| Insuration thickness (mm) | | 0.1 | 0.1 | 0.1 | 0.1 | 0.1 | 0.1 | 0.1 | 0.1 |
| Conductor cross-section area ($mm^2$) | | 0.35 | 0.35 | 0.35 | 0.35 | 0.35 | 0.35 | 0.35 | 0.35 |
| External diameter(mm) | | 0.90 | 0.90 | 0.90 | 0.90 | 0.90 | 0.90 | 0.90 | 0.90 |
| Wire evaluation | Resistance to liquid | Good | Good | Good | Good | Good | Good | Good | Good |
| | Resistance to electrolyte | Passed | Passed | Passed | Passed | Passed | Passed | Passed | Passed |

TABLE 3

| | | Example | | | | | | | |
|---|---|---|---|---|---|---|---|---|---|
| | | 17 | 18 | 19 | 20 | 21 | 22 | 23 | 24 |
| Ingredient A | Polysulfone | | | 95 | | | 60 | | |
| | Polyethersulfone | 95 | | | 60 | 95 | | | 40 |
| | Polyphenylsulfone | | 60 | | | | | 95 | 20 |
| Ingredient B | Polyethylene terephthalate | 5 | | | | | 40 | | |
| | Polybutylene naphthalate | | | 5 | 40 | 5 | | | 40 |
| | Polyethylene naphthalate | | 40 | | | | | 5 | |
| Insuration thickness (mm) | | 0.2 | 0.3 | 0.3 | 0.3 | 0.7 | 0.7 | 0.7 | 0.7 |
| Conductor cross-section area ($mm^2$) | | 0.35 | 0.35 | 2 | 3 | 8 | 8 | 15 | 15 |
| External diameter(mm) | | 1.1 | 1.3 | 2.5 | 3.0 | 5.1 | 5.1 | 6.8 | 6.8 |
| Wire evaluation | Resistance to liquid | Good | Good | Good | Good | Good | Good | Good | Good |
| | Resistance to electrolyte | Passed | Passed | Passed | Passed | Passed | Passed | Passed | Passed |

TABLE 4

| | | Example | | | | | | | |
|---|---|---|---|---|---|---|---|---|---|
| | | 25 | 26 | 27 | 28 | 29 | 30 | 31 | 32 |
| Ingredient A | Polysulfone | 95 | | 75 | 20 | 35 | 45 | 95 | |
| | Polyethersulfone | | 60 | | 20 | | 15 | | |
| | Polyphenylsulfone | | | 20 | 20 | 60 | | | 80 |
| Ingredient B | Polyethylene terephthalate | 3 | 20 | 1 | 20 | 5 | 20 | | |
| | Polybutylene naphthalate | 2 | 20 | 1 | 10 | | | 5 | |
| | Polyethylene naphthalate | | | 3 | 10 | | 20 | | 20 |
| Insuration thickness (mm) | | 0.9 | 0.7 | 0.7 | 0.7 | 0.9 | 0.9 | 1.1 | 1.1 |
| Conductor cross-section area ($mm^2$) | | 15 | 20 | 20 | 20 | 20 | 20 | 20 | 20 |
| External diameter(mm) | | 7.2 | 7.5 | 7.5 | 7.5 | 7.9 | 7.9 | 8.3 | 8.3 |
| Wire evaluation | Resistance to liquid | Good | Good | Good | Good | Good | Good | Good | Good |
| | Resistance to electrolyte | Passed | Passed | Passed | Passed | Passed | Passed | Passed | Passed |

TABLE 5

| | | Comparative Example | | | | | | | |
|---|---|---|---|---|---|---|---|---|---|
| | | 1 | 2 | 3 | 4 | 5 | 6 | 7 | 8 |
| Ingredient A | Polysulfone | 100 | | | | | | | |
| | Polyethersulfone | | 100 | | | | | 97 | |
| | Polyphenylsulfone | | | 100 | | | | | 50 |
| Ingredient B | Polyethylene terephthalate | | | | 100 | | | | |
| | Polybutylene naphthalate | | | | | 100 | | 3 | |
| | Polyethylene naphthalate | | | | | | 100 | | 50 |
| Insuration thickness (mm) | | 0.1 | 0.1 | 0.1 | 0.1 | 0.1 | 0.1 | 0.1 | 0.1 |
| Conductor cross-section area ($mm^2$) | | 0.35 | 0.35 | 0.35 | 0.35 | 0.35 | 0.35 | 0.35 | 0.35 |
| External diameter(mm) | | 0.90 | 0.90 | 0.90 | 0.90 | 0.90 | 0.90 | 0.90 | 0.90 |
| Wire evaluation | Resistance to liquid | Poor | Poor | Average | Good | Good | Good | Average | Good |
| | Resistance to electrolyte | Passed | Passed | Passed | Failed | Failed | Failed | Passed | Failed |

TABLE 6

| | | Comparative Example | | | | | | | |
|---|---|---|---|---|---|---|---|---|---|
| | | 9 | 10 | 11 | 12 | 13 | 14 | 15 | 16 |
| Ingredient A | Polysulfone | 55 | | 25 | | | 30 | 50 | |
| | Polyethersulfone | | | 25 | 57 | 20 | | | |
| | Polyphenylsulfone | | 97 | | 40 | | 20 | 50 | |
| Ingredient B | Polyethylene terephthalate | | | 25 | | 30 | | | 30 |
| | Polybutylene naphthalate | 45 | 3 | 25 | 1 | 30 | | | 40 |
| | Polyethylene naphthalate | | | | 2 | 20 | 50 | | 30 |
| Insuration thickness (mm) | | 0.1 | 0.1 | 0.1 | 0.1 | 0.1 | 0.1 | 0.1 | 0.1 |
| Conductor cross-section area ($mm^2$) | | 0.35 | 0.35 | 0.35 | 0.35 | 0.35 | 0.35 | 0.35 | 0.35 |
| External diameter(mm) | | 0.90 | 0.90 | 0.90 | 0.90 | 0.90 | 0.90 | 0.90 | 0.90 |
| Wire evaluation | Resistance to liquid | Good | Average | Good | Poor | Good | Good | Poor | Good |
| | Resistance to electrolyte | Failed | Passed | Failed | Passed | Failed | Failed | Passed | Failed |

TABLE 7

| | | Comparative Example | | | | | | | |
|---|---|---|---|---|---|---|---|---|---|
| | | 17 | 18 | 19 | 20 | 21 | 22 | 23 | 24 |
| Ingredient A | Polysulfone | 100 | | | | | 97 | | |
| | Polyethersulfone | | 97 | | 100 | | | | 55 |
| | Polyphenylsulfone | | | 55 | | 55 | | 100 | |
| Ingredient B | Polyethylene terephthalate | | 3 | | | | | | 45 |
| | Polybutylene naphthalate | | | | | 45 | | | |
| | Polyethylene naphthalate | | | 45 | | | 3 | | |
| Insuration thickness (mm) | | 0.2 | 0.3 | 0.3 | 0.3 | 0.7 | 0.7 | 0.7 | 0.7 |
| Conductor cross-section area ($mm^2$) | | 0.35 | 0.35 | 2 | 3 | 8 | 8 | 15 | 15 |
| External diameter(mm) | | 1.10 | 1.30 | 2.50 | 3.00 | 5.10 | 5.10 | 6.80 | 6.80 |
| Wire evaluation | Resistance to liquid | Poor | Average | Good | Poor | Good | Poor | Poor | Good |
| | Resistance to electrolyte | Passed | Passed | Failed | Passed | Failed | Passed | Passed | Failed |

TABLE 8

| | | Comparative Example | | | | | | | |
|---|---|---|---|---|---|---|---|---|---|
| | | 25 | 26 | 27 | 28 | 29 | 30 | 31 | 32 |
| Ingredient A | Polysulfone | | 97 | | | | 37 | | |
| | Polyethersulfone | | | 47 | 97 | | | 25 | |
| | Polyphenylsulfone | | | 50 | | | 60 | 30 | |
| Ingredient B | Polyethylene terephthalate | 100 | 3 | | 1 | | 1 | 15 | |
| | Polybutylene naphthalate | | | 3 | 1 | 100 | 1 | 10 | |
| | Polyethylene naphthalate | | | | 1 | | 1 | 20 | 100 |
| Insuration thickness (mm) | | 0.9 | 0.7 | 0.7 | 0.7 | 0.9 | 0.9 | 1.1 | 1.1 |
| Conductor cross-section area ($mm^2$) | | 15 | 20 | 20 | 20 | 20 | 20 | 20 | 20 |
| External diameter(mm) | | 7.20 | 7.50 | 7.50 | 7.50 | 7.90 | 7.90 | 8.30 | 8.30 |
| Wire evaluation | Resistance to liquid | Good | Poor | Poor | Average | Good | Poor | Good | Good |
| | Resistance to electrolyte | Failed | Passed | Passed | Passed | Failed | Passed | Failed | Failed |

It is shown in Tables 1 to 4 that all of the insulated wires according to Examples 1 to 32 of the present invention had satisfactory resistances to a liquid, and satisfactory resistances to an electrolyte.

It is shown in Tables 5 to 8 that the insulated wires according to Comparative Examples 1 to 3, 15, 17, 20 and 23, which were made only from the polysulfone resins while containing no aromatic polyester resin, had insufficient resistances to a liquid. In addition, it is shown that the insulated wires according to Comparative Examples 4 to 6, 16, 25, 29 and 32, which were made only from the aromatic polyester resins while containing no polysulfone resin, had insufficient resistances to an electrolyte.

In addition, it is shown that the insulated wires according to Comparative Examples 7 to 14, 18 to 19, 21 to 22, 24, 26 to 28, and 30 to 31 had insufficient resistances to a liquid and insufficient resistances to an electrolyte because the ratio between the ingredient A and the ingredient B of each insulated wire was out of the range specified in the present invention.

The invention claimed is:

1. An automotive insulated wire comprising:

a metallic conductor; and an insulation covering layer that covers the outer periphery of the metallic conductor, wherein the insulation covering layer comprises a mixed resin composition that comprises resin ingredients that comprise an ingredient A: a polysulfone resin, and an ingredient B: an aromatic polyester resin comprising polybutylene napthalate, and wherein a total of 100 parts by mass of the ingredients A and B in the mixed resin composition comprises 95 to 60 parts by mass of the ingredient A, and 5 to 40 parts by mass of the ingredient B.

2. The automotive insulated wire according to claim 1, wherein the ingredient A: the polysulfone resin, has a flexural modulus of 2400 MPa or more, and comprises one or more resins selected from the group consisting of polysulfone, polyethersulfone, and polyphenylsulfone.

3. The automotive insulated wire according to claim 1, wherein the ingredient B: the aromatic polyester resin, has a melting point of 240 degrees C. or higher, and further comprises one or more resins selected from the group consisting of polyethylene terephthalate and polyethylene naphthalate.

4. An automotive wiring harness comprising the automotive insulated wire according to claim 1.

5. The automotive insulated wire according to claim 2, wherein the ingredient B: the aromatic polyester resin, has a melting point of 240 degrees C. or higher, and further comprises one or more resins selected from the group consisting of polyethylene terephthalate and polyethylene naphthalate.

6. An automotive wiring harness comprising the automotive insulated wire according to claim 2.

7. An automotive wiring harness comprising the automotive insulated wire according to claim 3.

8. An automotive wiring harness comprising the automotive insulated wire according to claim 5.

9. The automotive insulated wire according to claim 1, wherein a total of 100 parts by mass of the ingredients A and B in the mixed resin composition comprises 95 parts by mass of the ingredient A, and 5 parts by mass of the ingredient B.

10. The automotive insulated wire according to claim 9, wherein the ingredient A: the polysulfone resin, has a flexural modulus of 2400 MPa or more, and comprises one or more resins selected from the group consisting of polysulfone, polyethersulfone, and polyphenylsulfone.

11. The automotive insulated wire according to claim 9, wherein the ingredient B: the aromatic polyester resin, has a melting point of 240 degrees C. or higher, and further comprises one or more resins selected from the group consisting of polyethylene terephthalate and polyethylene naphthalate.

12. An automotive wiring harness comprising the automotive insulated wire according to claim 9.

13. The automotive insulated wire according to claim 10, wherein the ingredient B: the aromatic polyester resin, has a melting point of 240 degrees C. or higher, and further comprises one or more resins selected from the group consisting of polyethylene terephthalate and polyethylene naphthalate.

14. An automotive wiring harness comprising the automotive insulated wire according to claim 10.

15. An automotive wiring harness comprising the automotive insulated wire according to claim 11.

16. An automotive wiring harness comprising the automotive insulated wire according to claim 13.

* * * * *